US006843679B2

(12) United States Patent
Kuo et al.

(10) Patent No.: US 6,843,679 B2
(45) Date of Patent: Jan. 18, 2005

(54) CABLE CONNECTOR ASSEMBLY

(75) Inventors: Chin Pao Kuo, Tu-Chen (TW); Shih Tung Chang, Tu-Chen (TW); Yun Lung Ko, Tu-chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 14 days.

(21) Appl. No.: 10/342,492

(22) Filed: Jan. 14, 2003

(65) Prior Publication Data

US 2004/0127098 A1 Jul. 1, 2004

(30) Foreign Application Priority Data

Dec. 25, 2002 (TW) ..... 91221056

(51) Int. Cl.[7] ..... H01R 9/07
(52) U.S. Cl. ..... 439/497
(58) Field of Search ..... 439/497, 597, 439/607, 610

(56) References Cited

U.S. PATENT DOCUMENTS 5,042,971 A * 8/1991 Ambrose ..... 439/77
5,980,308 A * 11/1999 Hu et al. ..... 439/497
6,273,749 B1 * 8/2001 Yang ..... 439/497
6,273,753 B1 * 8/2001 Ko ..... 439/579
6,305,978 B1 * 10/2001 Ko et al. ..... 439/579
6,309,243 B1 * 10/2001 Tu et al. ..... 439/497

* cited by examiner

*Primary Examiner*—Thanh-Tam Le
(74) *Attorney, Agent, or Firm*—Wei Te Chung

(57) ABSTRACT

A cable connector assembly (100) includes a cable connector (1), a grounding bar (2), a number of wires (3) terminated by the connector, and a piece of conductive tape (4). The cable connector has an insulative housing (10), a terminal insert (12) retaining therein a number of terminals (122), and a metallic shell (14) covering the housing. The terminals include a number of signal terminals (122*a*) conductively connecting with the wires, a number of ground terminals (122*b*) arranged between the signal terminals, and a number of power terminals (122*c*) located beside the signal and ground terminals. The grounding bar has a main plate (20) positioned outside the housing and a number of ground fingers (22) extending from an edge of the main plate and electrically connecting with corresponding ground terminals. The conductive tape substantially wraps about the grounding bar and electrically connects with the metallic shell.

4 Claims, 5 Drawing Sheets

CABLE CONNECTOR ASSEMBLY

BACKGROUND OF THE INVENTION

1. Field of the Invention

The present invention generally relates to a cable connector assembly, and particularly to a cable connector assembly used in a notebook computer.

2. Description of Prior Arts

A computer system, such as a personal computer or notebook computer, emits EMI radiation and other electronic "noise" due to the electronic components included in the computer system. Various threshold values defining acceptable levels of EMI radiation from a computer system have been established, for example, by government agencies. To be EMI-compliant in accordance with these established EMI radiation limits, computer manufacturers have taken steps to minimize EMI radiation levels emitted from various components of computer systems and also to minimize EMI radiation levels emitted from wires and cables used to interconnect various components, such as to connect a display device to the motherboard.

FIGS. 4 and 5 illustrate two traditional methods for grounding a cable connector assembly. As shown in FIG. 4, grounding lines 2' of a conventional cable connector assembly electrically connect with a motherboard via a cable connector 1' so that shield the cable connector assembly from EMI. However, it requires a long way for the grounding lines 2' to go to eliminate the noise and, obviously, the EMI effect is not good. Referring to FIG. 5, another kind of cable assembly includes a cable connector I", a number of signal lines 2" and a number of grounding lines 3". In a predetermined position adjacent to the cable connector 1", a layer of foil 4" covers corresponding portions of the signal lines 2" and the grounding lines 3" are soldered with the foil layer 4 so that achieve a grounding effect. However, this kind of cable assembly is too complicated to be manufactured, which unavoidably increases the produce-cost.

Hence, an improved cable assembly used in a notebook computer is highly desired to overcoming the above-mentioned defects of current art.

BRIEF SUMMARY OF THE INVENTION

Accordingly, an object of the present invention is to provide a cable connector assembly which can achieve an effective grounding against EMI.

Another object of the present invention is to provide a cable connector assembly which can be easily manufactured and assembled.

In order to achieve the above-mentioned objects, a cable connector assembly in accordance with the present invention includes a cable connector, a grounding bar, a number of wires terminated by the connector, and a piece of conductive tape. The-cable connector has an insulative housing, a terminal insert retaining therein a number of terminals, and a metallic shell covering the insulative housing. The terminals include a number of signal terminals conductively connecting with the wires, a number of ground terminals arranged between the signal terminals, and a number of power terminals located beside the signal and ground terminals. The grounding bar has a main plate and a number of ground fingers extending from an edge of the main plate. The main plate is positioned outside the insulative housing while the ground fingers electrically connect with corresponding ground terminals. The conductive tape substantially wraps about the grounding bar and electrically connects with the metallic shell.

Other objects, advantages and novel features of the invention will become more apparent from the following detailed description of the present embodiment when taken in conjunction with the accompanying drawings.

DETAILED DESCRIPTION OF THE INVENTION

Figure 1:
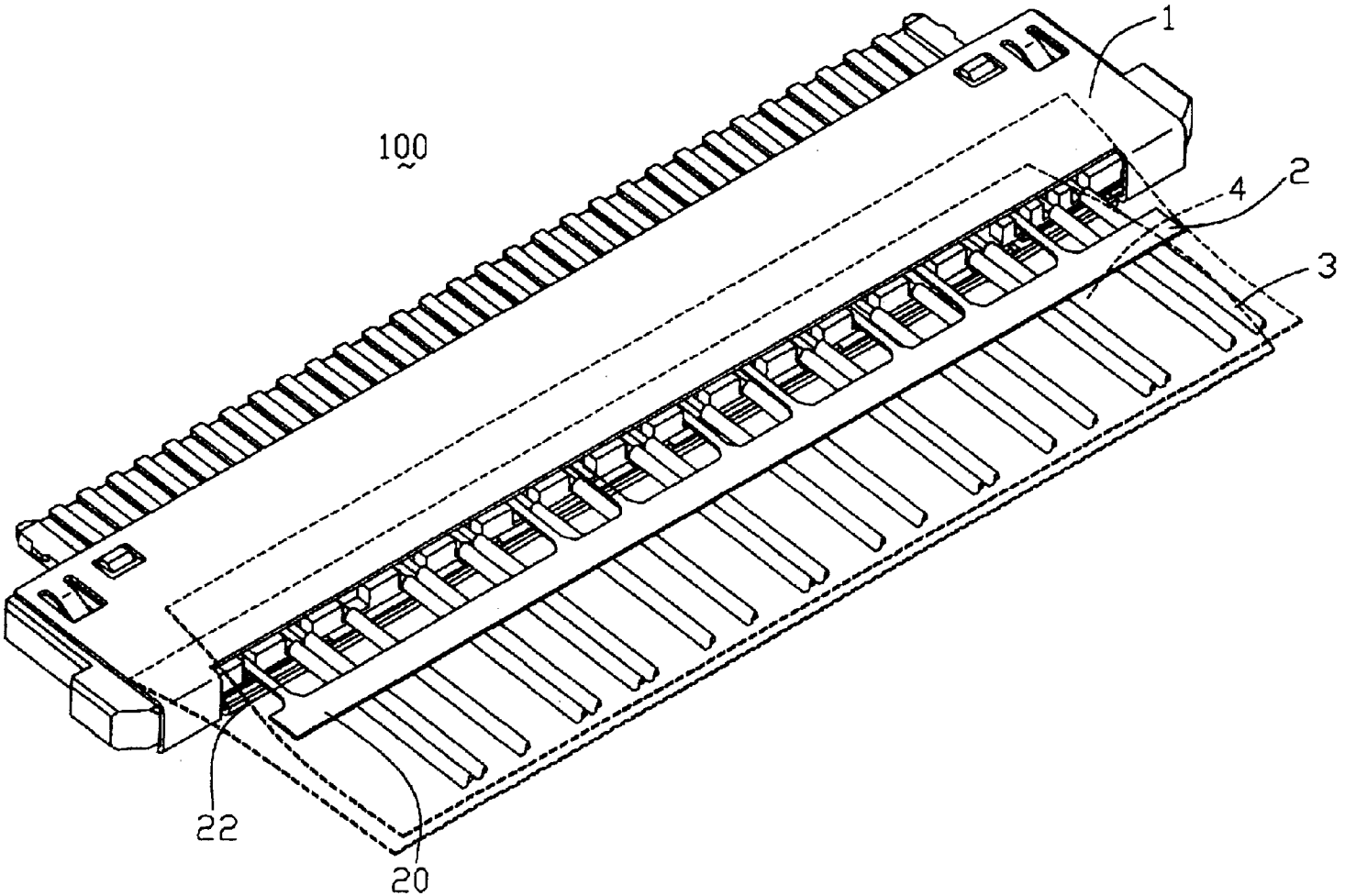
FIG. 1 is a perspective view of a cable connector assembly in accordance with the present invention.

Reference will now be made to the drawing figures to describe the present invention in detail.

Figure 2:
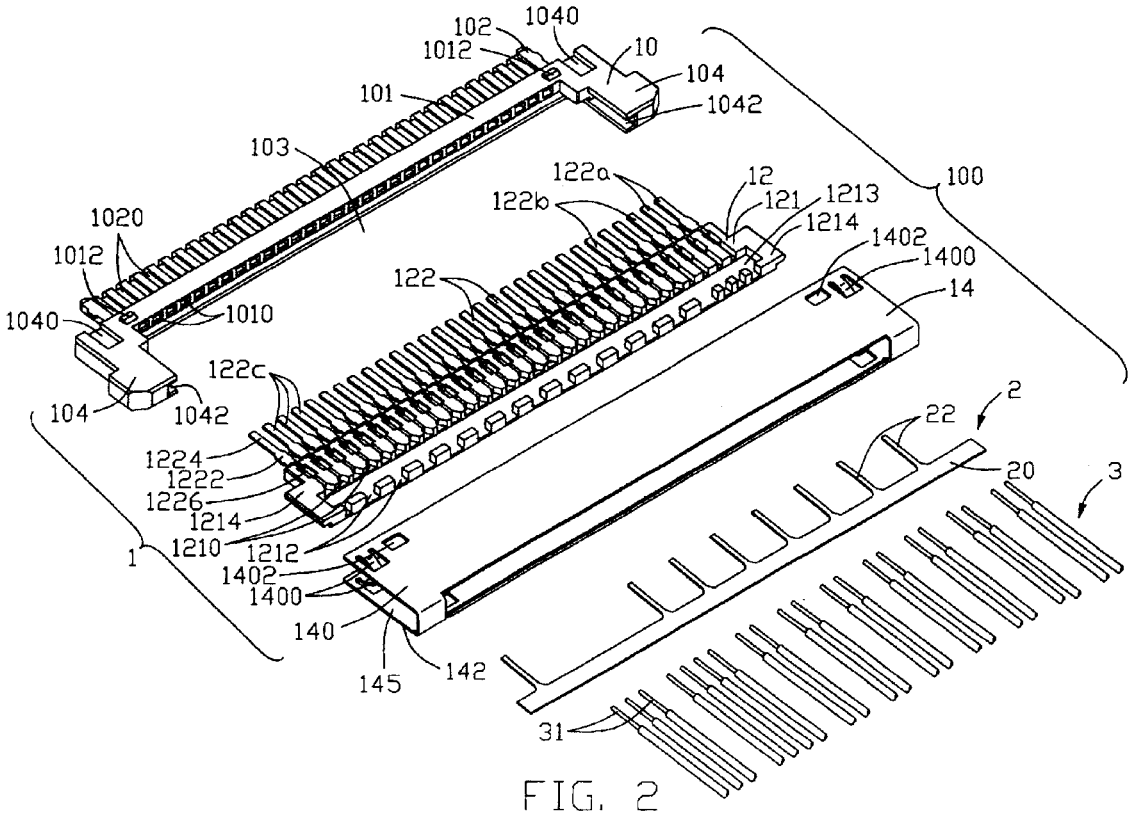
FIG. 2 is an exploded, perspective view of the cable connector assembly shown in FIG. 1 with a conductive tape being removed therefrom.
Figure 3:
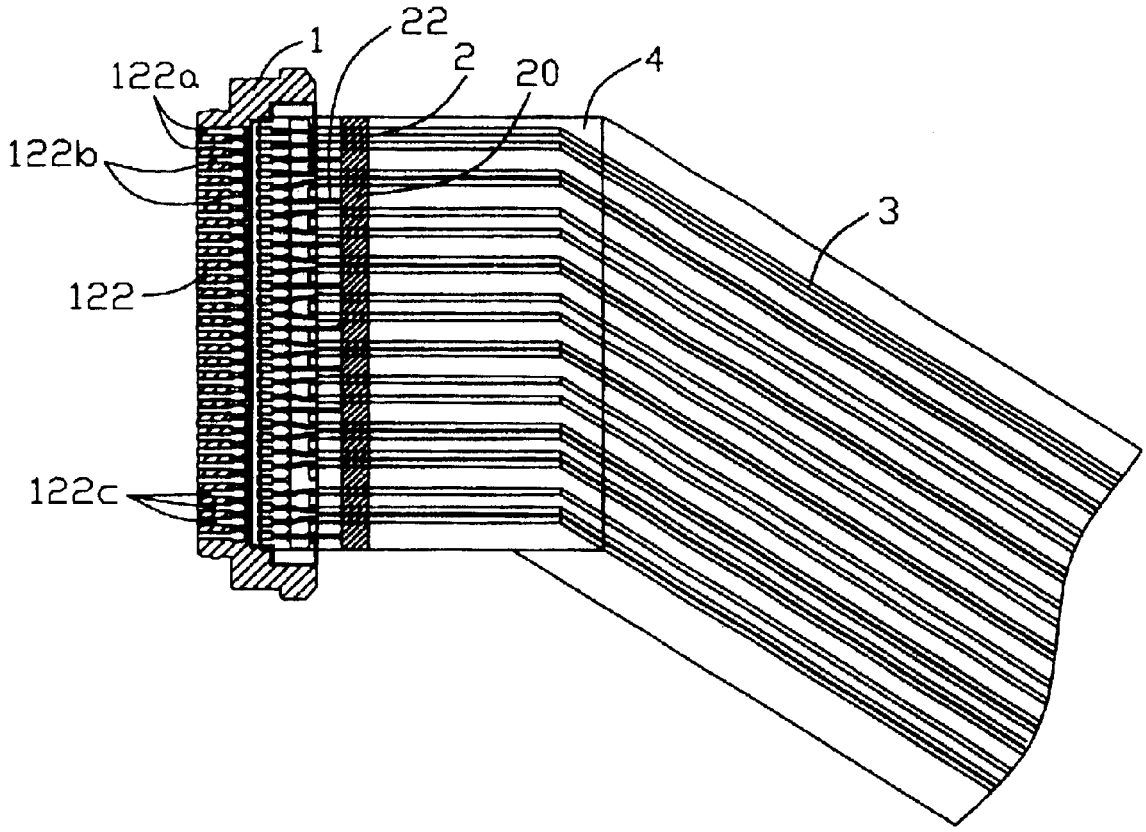
FIG. 3 is a top cross-section view of the cable connector assembly shown in FIG. 1.
Figure 4:
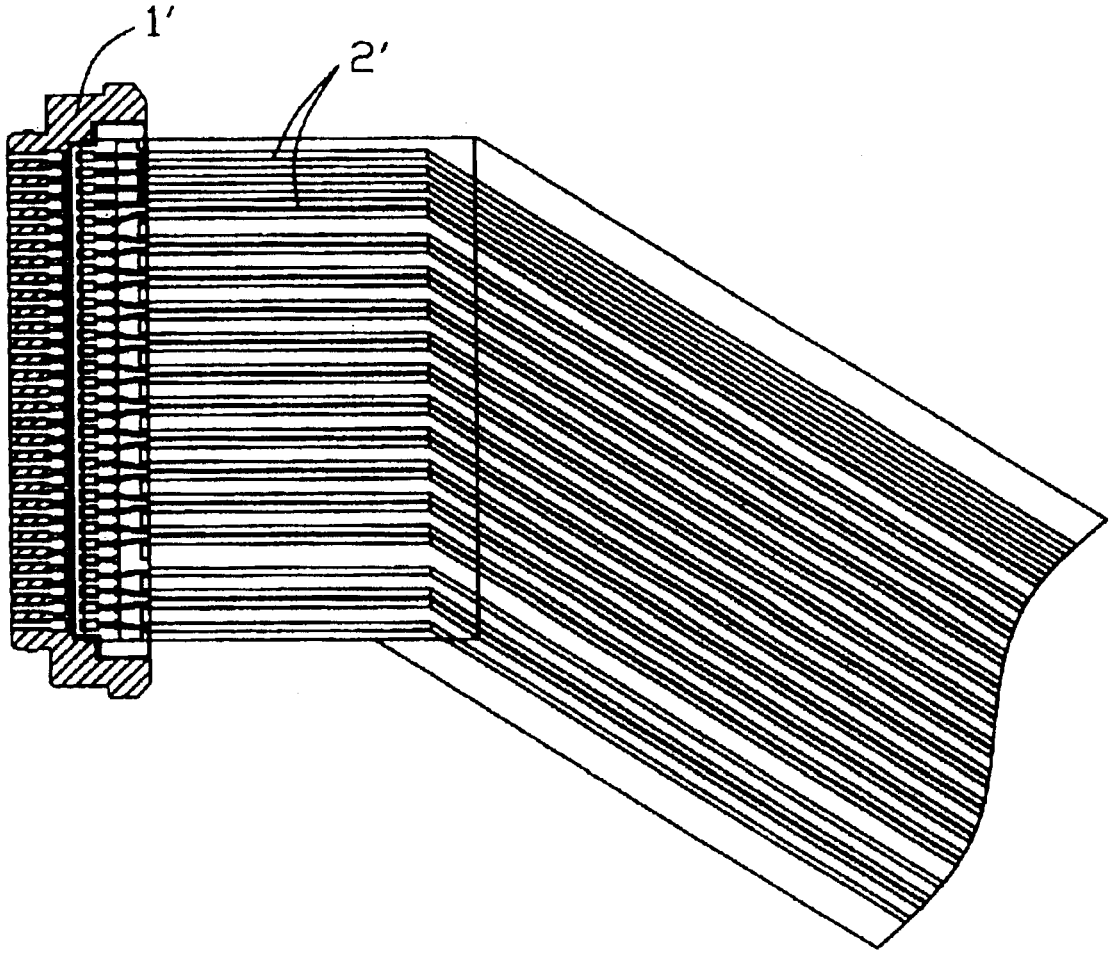
FIG. 4 (PRIOR ART)
FIG. 4 is a top cross-section view of a conventional cable connector assembly.
Figure 5:
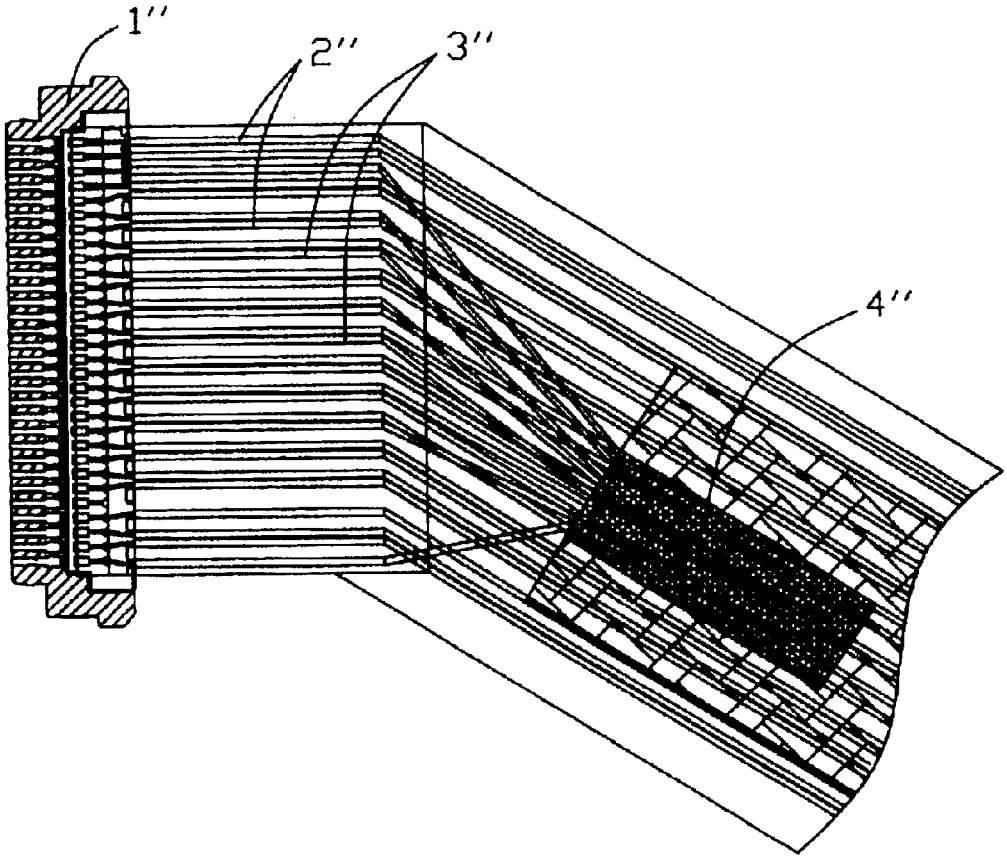
FIG. 5 (PRIOR ART)
FIG. 5 is a top cross-section view of another conventional cable connector assembly.

Together referring to FIGS. 1 and 2, a cable connector assembly 100 in accordance with the present invention, which is adapted to use with an LCD device, includes a cable connector 1, a grounding bar 2, a number of wires 3 terminated by the connector 1, and a piece of conductive tape 4 attached to the cable connector 1.

As best shown in FIG. 2, the electrical connector 1 comprises an insulative housing 10, a terminal insert 12 received in the insulative housing 10, and a metallic shell 14 surrounding the housing 10 and the terminal insert 12. The insulative housing 10 has an elongated base portion 101, a tongue portion 102 extending forwardly from a longitudinal edge of the base portion 101, and a pair of arms 104 protruding rearwardly from two opposite lateral sides of the base portion 101. A receiving space 103 is defined between the pair of arms 104 and the elongated base portion 101 for receiving the terminal insert 12. A number of passageways 1010 are defined in the base portion 101 and communicate respectively with a number of recesses 1020 defined in the tongue portion 102. The pair of arms 104 each have two depressions 1040 respectively defined on opposite top and bottom faces, and have a slit 1042 defined in an inner side thereof. A number of embossments 1012 are formed on a top surface of the elongated base portion 101.

Continue to FIG. 2, the terminal insert 12 received in the receiving space 103 of the insulative housing 10 includes an insulative, main body 121 and a number of conductive terminals 122 retained in the main body 121. The conductive terminals 122 include a number of signal terminals 122*a* for signal transmission, a number of ground terminals 122*b* and a number of power terminals 122c. Each terminal 122 comprises a retention portion 1222 received in the passageway 1010, a contact portion 1224 exposed in the recess 1020 for electrically engaging with a complementary connector (not shown), and a tail portion 1226. The main body 121 defines a number of terminal receiving slots 1210 for receiving the tail portions 1226 of the terminals 122 and a number of channels 1212 correspondingly communicating with the terminal receiving slots 1210 through an elongated slot 1213. A pair of ears 1214 project from two opposite lateral edges of the main body 121 for engaging within the slits 1042 of the insulative housing 10 to thereby secure the terminal insert 12 within the housing 10.

The grounding bar 2 is stamped from a metal sheet and comprises an elongated main plate 20 and a number of ground fingers 22 extending forwardly from a forward edge of the main plate 20. The engagement between the grounding bar 2 and the connector 1 will be described in great detail hereinafter.

The metallic shell 14 is also stamped from a metal sheet and is configured in a U-shape. A receiving cavity 145 is defined between an upper portion 140 and an opposite lower portion 142. Each portion 140, 142 defines two opposite resilient tabs 1400 extending inwardly for engaging with corresponding depressions 1040 of the housing 10. The upper portion 140 also forms a number of cutouts 1402 for receiving corresponding embossments 1012 of the housing 10.

In assembly, the number of terminals 122 are inserted into the insulative main body 121 of the terminal insert 12. End portions of the wires 3 are arranged in corresponding channels 1212 of the terminal insert 12 with inner conductors 31 thereof extending into the terminal receiving slots 1210 and conductively connecting with the tail portions 1226 of corresponding signal terminals 122*a*. The ground fingers 22 of the grounding bar 2 are also inserted into corresponding channels 1212 of the terminal insert 12 and conductively soldered with the tail portions 1226 of corresponding ground terminals 122*b* to thereby achieve a grounding purpose. While, the main plate 20 of the grounding bar 2 is positioned outside the cable connector 1.

A subassembly composed by the terminal insert 12, the grounding bar 2 and the wires 3, is inserted into and received in the receiving space 103 of the insulative housing 10 with the two ears 1214 engaging within the slits 1042, the retention portions 1222 of the terminals 122 interference fitted in the corresponding passageways 1010 and with the contact portions 1224 extending and exposing in the corresponding recesses 1020. Then, the housing 10 together with the subassembly is received in the receiving cavity 145 of the metallic shell 14, wherein the resilient tabs 1400 of the metallic shell 14 are retained in the depressions 1040 of the housing 10 and the cutouts 1402 engage with the embossments 1012 so that the shell 14 is firmly attached on the housing 10 and the subassembly. Finally, particularly referring to FIG. 1, the conductive tape 4 substantially covers the grounding bar 2 and conductively connects with the shell 14. Therefore, a grounding path is established from the ground terminals 122*b* to the metallic shell 14 via the ground fingers 22, the main plate 20 of the grounding bar 2, and the conductive tape 4, respectively. It can be readily seen that the grounding bar 2 is located outside the connector 1 while the ground fingers 22 thereof are inserted into and electrically connecting with grounding terminals 122*b* so that the noise is substantially eliminated both outside and inside the connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A cable connector assembly comprising:

a cable connector having an insulative housing, a terminal insert retaining therein a number of terminals, and a metallic shell covering said insulative housing, said terminals including a number of signal terminals a number of ground terminals and a number of power terminals;

a number of wires electrically connecting with said signal terminals for signal transmission;

a grounding bar comprising a main plate and a number of ground fingers extending from an edge of said main plate, wherein said main plate is positioned outside said insulative housing while said ground fingers electrically connecting with corresponding ground terminals so that the noise is substantially eliminated both outside and inside the insulative housing; and a conductive tape substantially wrapping said grounding bar and electrically connecting with said metallic shell such that a grounding path is established from the ground terminals to the metallic shell via the ground fingers, the main plate of the ground bar, and the conductive tape, respectively; wherein, said insulative housing defines a receiving space for receiving said terminal insert; wherein said terminal insert comprises an insulative main body defining therein a number of terminal receiving slots and a number of channels communicating with said terminal receiving slots, said around fingers of said grounding bar and end portions of said wires being received in corresponding channels and extended into said terminal receiving slots.

2. The cable connector assembly as described in claim 1, wherein said insulative housing has an elongated base portion, a tongue portion extending forwardly from a longitudinal edge of said base portion, and a pair of arms protruding rearwardly from two opposite lateral sides of the base portion.

3. The cable connector assembly as described in claim 2, wherein said base portion of said insulative housing defines a number of passageways and said tongue portion defines a number of recesses communicating with said passageways.

4. The cable connector assembly as described in claim 3, wherein each terminal comprises a retention portion received in said passageway, a contact portion exposed in said recess for electrically engaging with a complementary component, and a tail portion received in said terminal receiving slot, said tail portions of said signal terminals conductively connecting with said end portions of said wires and said tail portions of said ground terminals conductively connecting with said ground fingers of said grounding bar.

* * * * *